US006367464B1

(12) United States Patent
Bronnert

(10) Patent No.: US 6,367,464 B1
(45) **Date of Patent: *Apr. 9, 2002**

(54) BOW LIMB ARTICULATION

(76) Inventor: Herve X. Bronnert, 21495 Partridge Ct., Brookfield, WI (US) 53005

( * ) Notice: Subject to any disclaimer, the term of this patent is extended or adjusted under 35 U.S.C. 154(b) by 0 days.

This patent is subject to a terminal disclaimer.

(21) Appl. No.: 09/469,015

(22) Filed: Dec. 21, 1999

Related U.S. Application Data

(63) Continuation-in-part of application No. 09/172,801, filed on Oct. 14, 1998, now Pat. No. 6,029,644.

(51) Int. Cl.[7] ..... F41B 5/00

(52) U.S. Cl. ..... 124/23.1; 124/25.6

(58) Field of Search ..... 124/23.1, 25.6, 124/44.5, 86, 88

(56) References Cited

U.S. PATENT DOCUMENTS

| | | | | | |
|---|---|---|---|---|---|
| 4,227,509 | A | * | 10/1980 | Jones | 124/25.6 |
| 4,287,867 | A | * | 9/1981 | Islas | 124/25.6 |
| 4,461,267 | A | * | 7/1984 | Simonds et al. | 124/25.6 |
| 4,781,168 | A | * | 11/1988 | Lester | 124/25.6 |
| 4,858,588 | A | * | 8/1989 | Bozek | 124/25.6 X |
| 5,205,267 | A | * | 4/1993 | Burdick | 124/44.5 X |
| 5,388,564 | A | * | 2/1995 | Islas | 124/25.6 |
| 5,454,361 | A | * | 10/1995 | Bronnert | 124/23.1 |
| 5,499,618 | A | * | 3/1996 | Thompson | 124/25.6 |
| 5,934,264 | A | * | 8/1999 | Doornenbal | 124/25.6 |
| 6,029,644 | A | * | 2/2000 | Bronnert | 124/25.6 |

* cited by examiner

*Primary Examiner*—John A. Ricci
(74) *Attorney, Agent, or Firm*—Foley & Lardner

(57) ABSTRACT

A bow includes a riser and a pair of limbs attached to the support member and riser with a reed assembly including a string strip. The limbs are attached to rear of the riser. The bow may also include a string guide attached to the support member or support portion of the riser.

17 Claims, 16 Drawing Sheets

FIG. 5
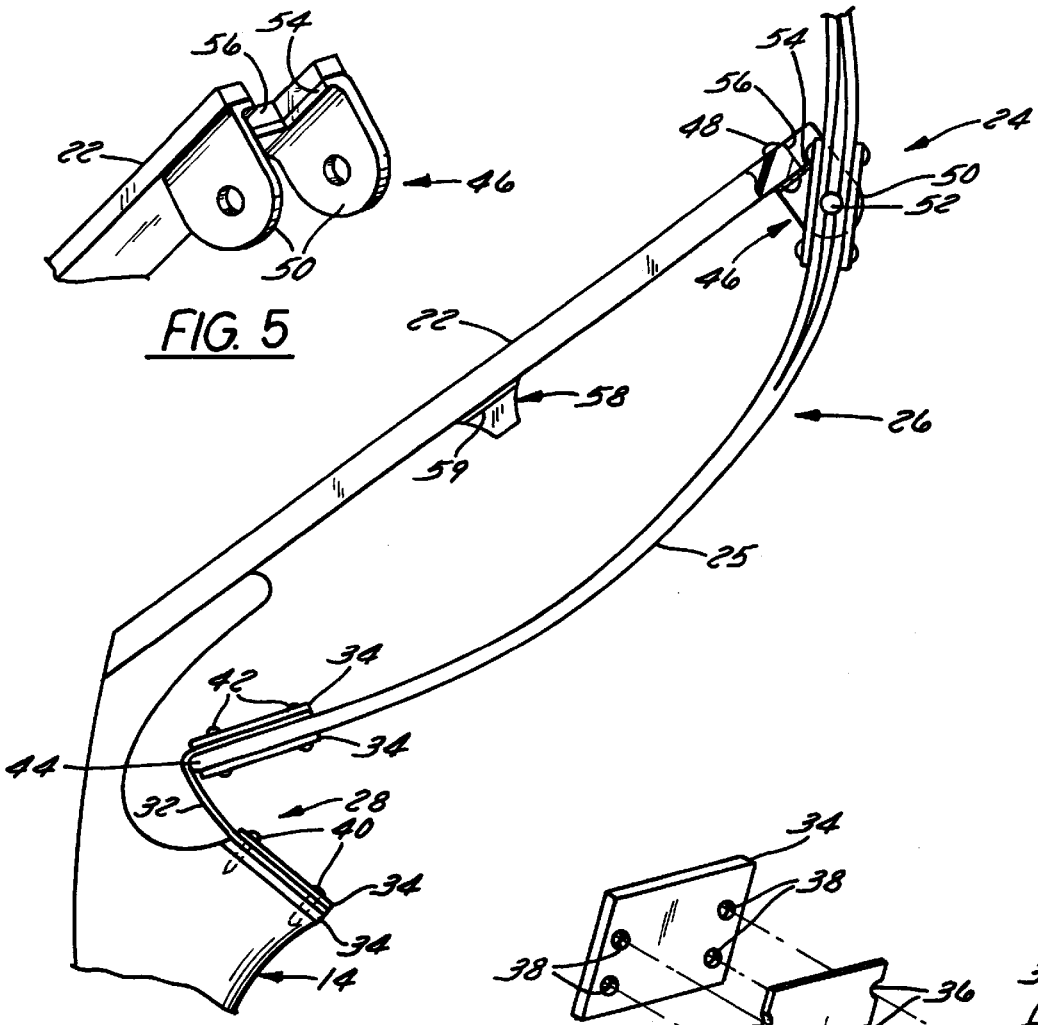
FIG. 3
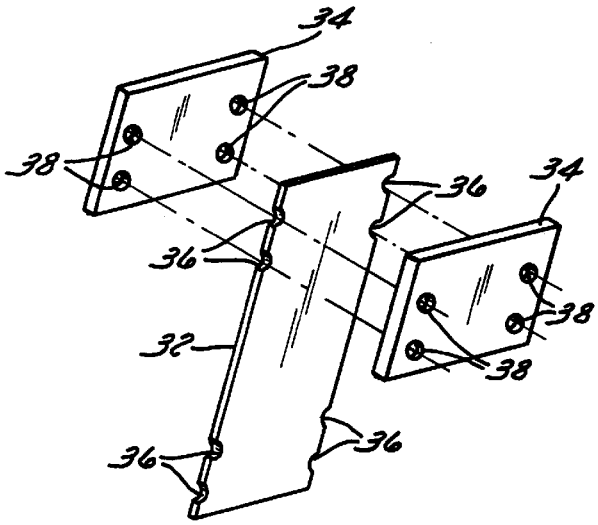
FIG. 4

FIG. 8
FIG. 9
FIG. 10
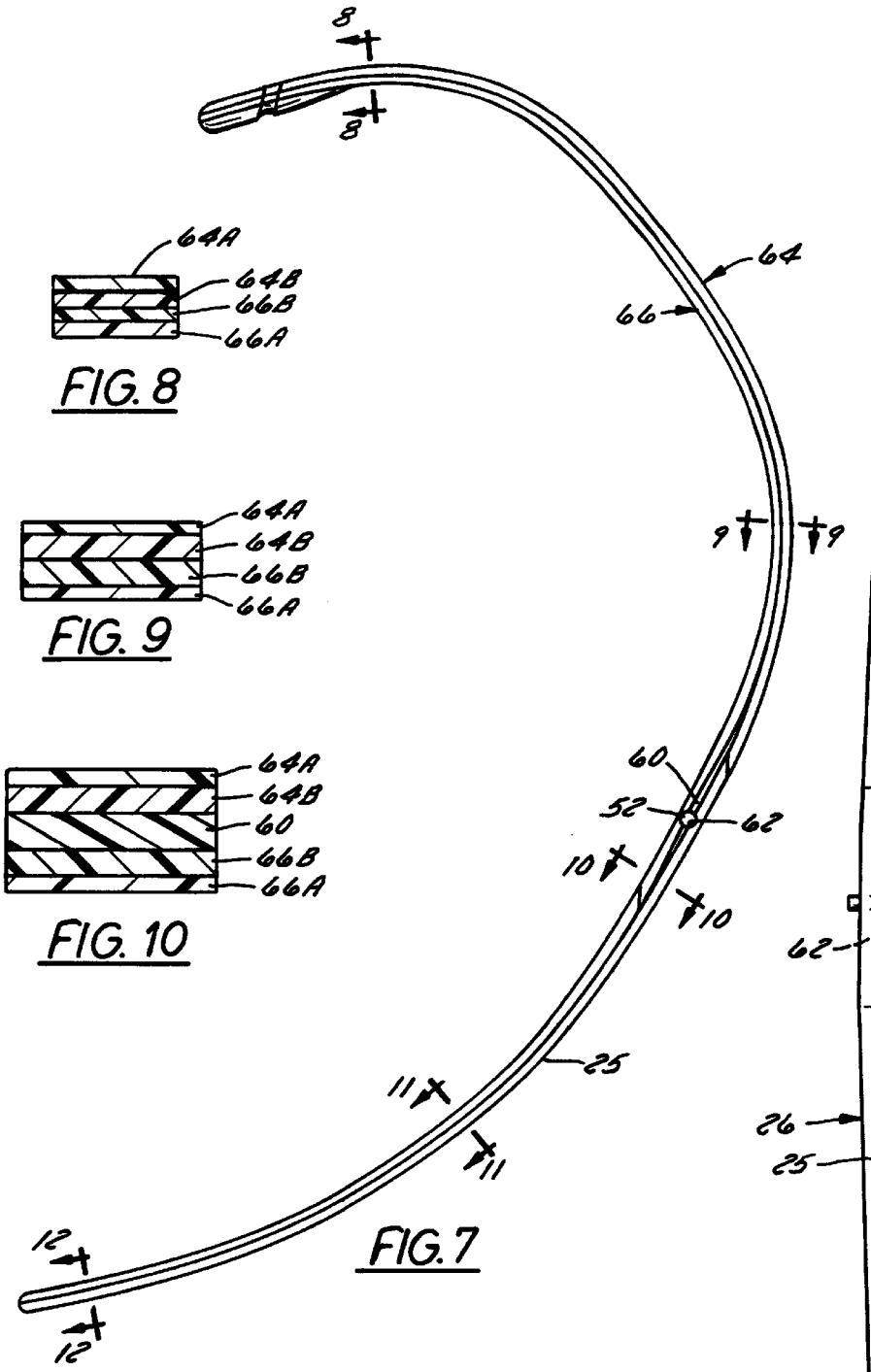
FIG. 7
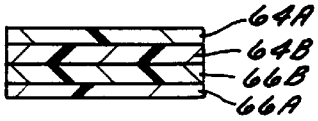
FIG. 12
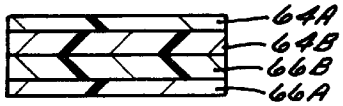
FIG. 11
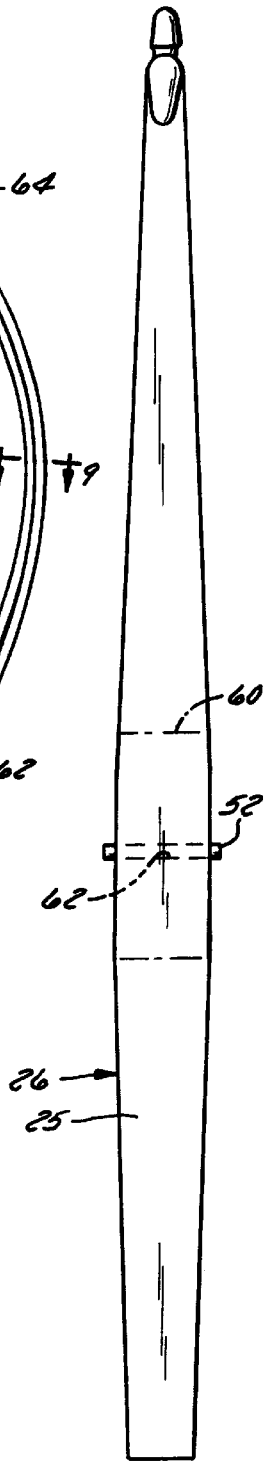
FIG. 6

310

314
324
22
22
23
21
A
D
322b
326
320
21
23
C
C'
24
316
322
318
24
312

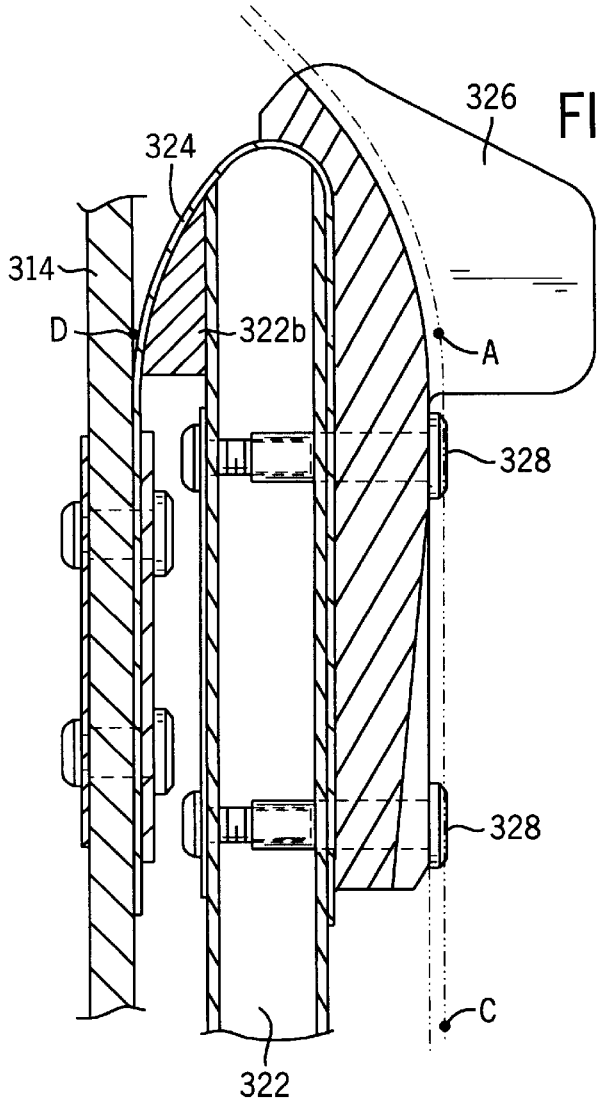
FIG. 21
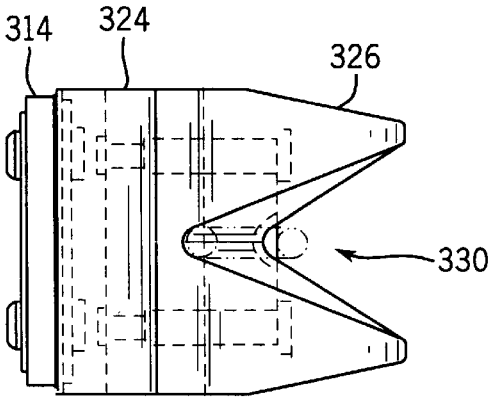
FIG. 22
FIG. 23
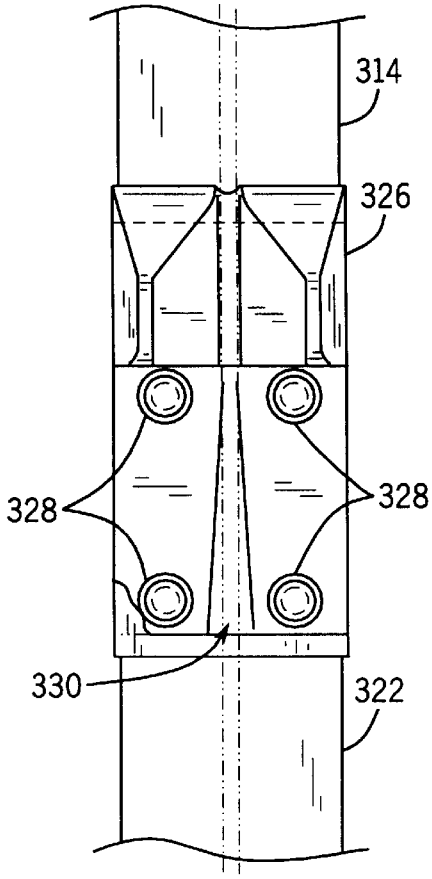

FIG. 27
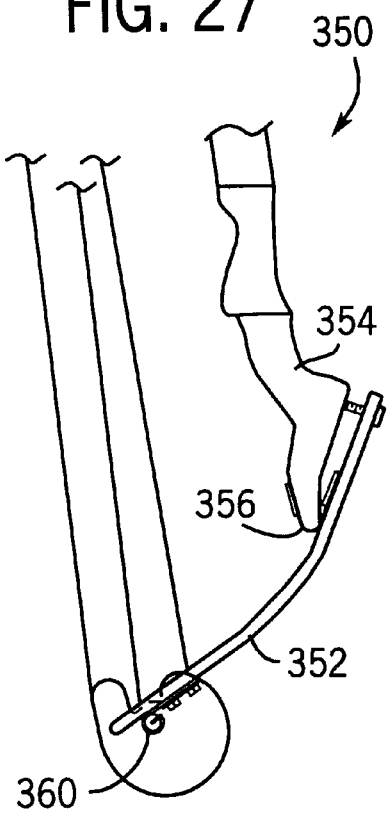
FIG. 28
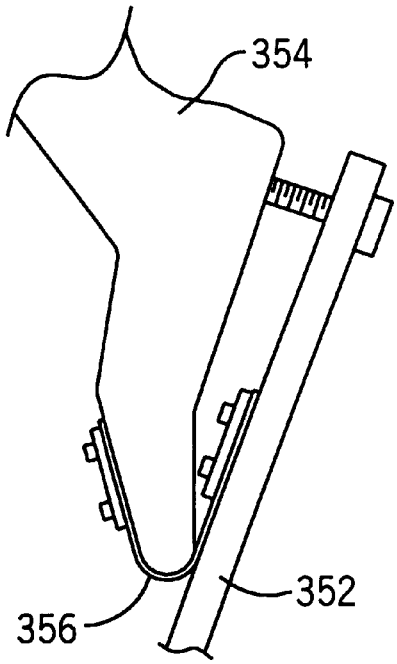
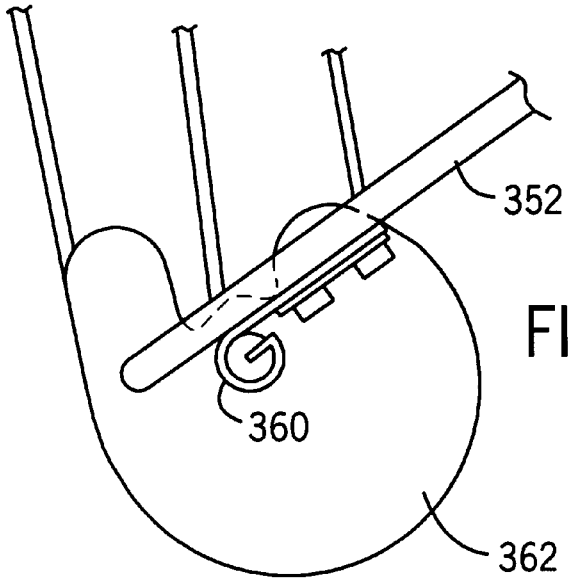
FIG. 29

BOW LIMB ARTICULATION

CROSS-REFERENCE TO RELATED APPLICATION

This application is a continuation-in-part of Ser. No. 09/172,801 filed Oct. 14, 1998 now U.S. Pat. No. 6,029,644.

FIELD OF THE INVENTION

The present invention relates to a bow including a riser having a support member on each end, a limb is mounted to the riser with a reed assembly.

BACKGROUND OF THE INVENTION

In my earlier U.S. Pat. No. 5,454,361, issued on Oct. 3, 1995, entitled "Sequential Bow," the bow included a hand held riser having a limb pivotally mounted on each end of the riser. Each limb including an inner section, an intermediate section and an outer section of different degrees of flexibility. A support member is mounted on each end of the risers in a position to engage the intermediate section of each of the limbs. A bow string is attached to the outer ends of the limbs so that the outer section of the limbs will be drawn together rearwardly of the support members to form a recurve in the inner section of the limb.

SUMMARY OF THE PRESENT INVENTION

In accordance with the present invention the bow includes a riser and a pair of limbs. Each limb having opposing ends and is operatively connected to the riser at one of the respective ends with a reed assembly or spring strip.

In another aspect of the invention the bow includes a riser and a pair of limbs. Each limb includes opposing ends and is operatively connected to the riser at one of the respective ends. A string guide located on the riser for guidance of a bowstring.

In a further aspect of the invention the bow includes a riser and a pair of limbs. Each limb includes opposing ends and is operatively connected to the riser at one of the respective ends. A wheel is operatively connected to one of the limbs with a reed assembly.

Other principal features and advantages of the invention will become apparent to those skilled in the art upon review of the following drawings, the detailed description and the appended claims.

BRIEF DESCRIPTION OF THE DRAWINGS

FIG. 3 is a view of the connections of the bow to the riser and the pivotal connection of the bow to the support member;

FIG. 4 is an exploded view of the reed connection to the riser and the limb;

FIG. 5 is a perspective view of the pivot assembly for connecting the limb to the support member;

FIG. 6 is a front view of the limb;

FIG. 7 is a side view of the limb;

FIG. 8 is a cross section view of the limb taken on line 8—8;

FIG. 9 is a view taken on line 9—9;

FIG. 10 is a view taken on line 10—10;

FIG. 11 is a view taken on line 11—11;

FIG. 12 is a view taken on line 12—12;

FIG. 21 is a cross sectional view detail view taken generally along line 21—21 of FIG. 20;

FIG. 22 is a top of the string guide view taken generally along line 22—22 of FIG. 20;

FIG. 23 is a back view of the string guide taken generally along line 23—23 of FIG. 20;

FIG. 27 is a partial side view of a bow according to a fourth embodiment;

FIG. 28 is a side view of the bottom reed assembly of the bow in FIG. 27;

FIG. 29 is a side view of the end reed assembly of the bow in FIG. 27.

Figure 1:
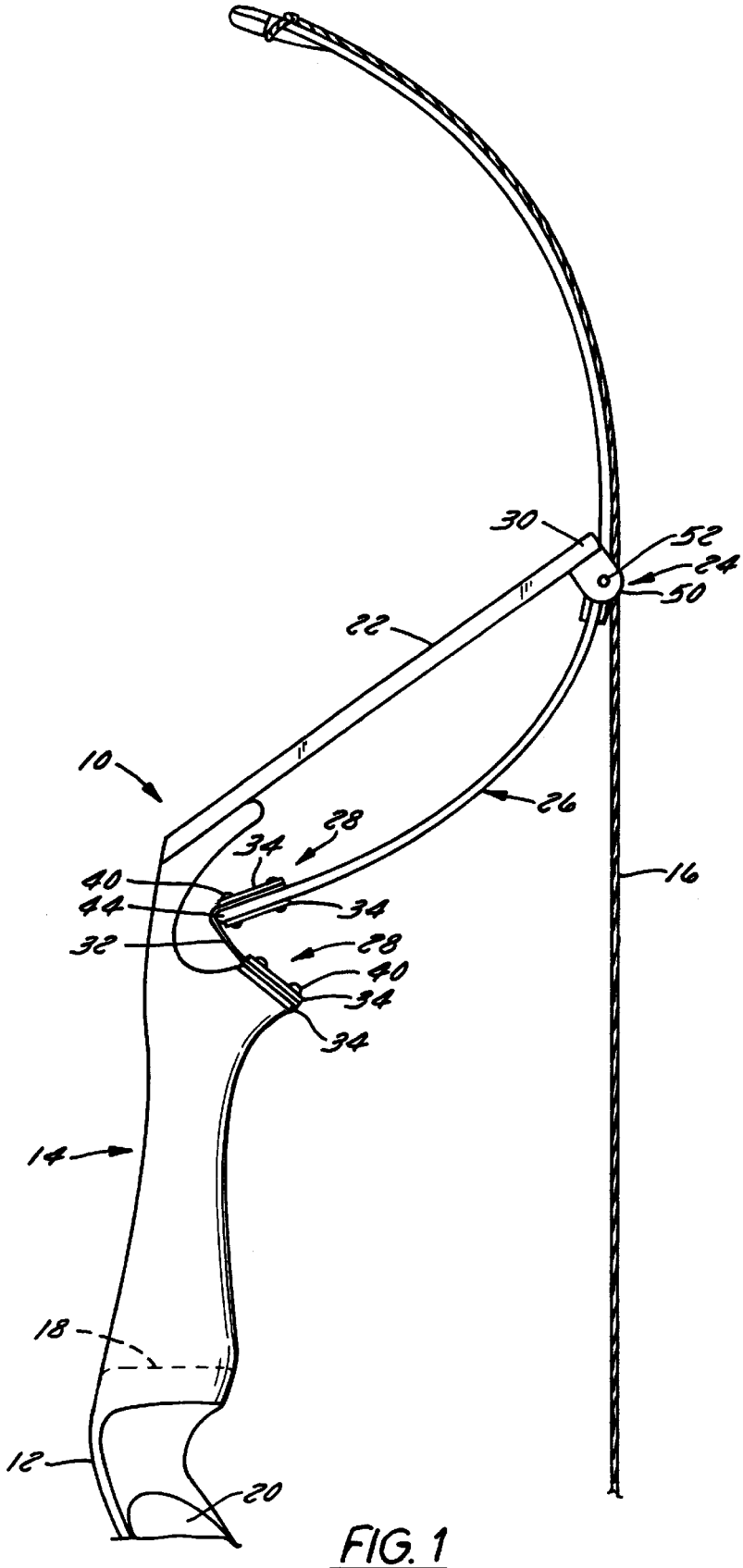
FIG. 1 is a side view of the upper half of the bow according to the present invention.

Before explaining the embodiments of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
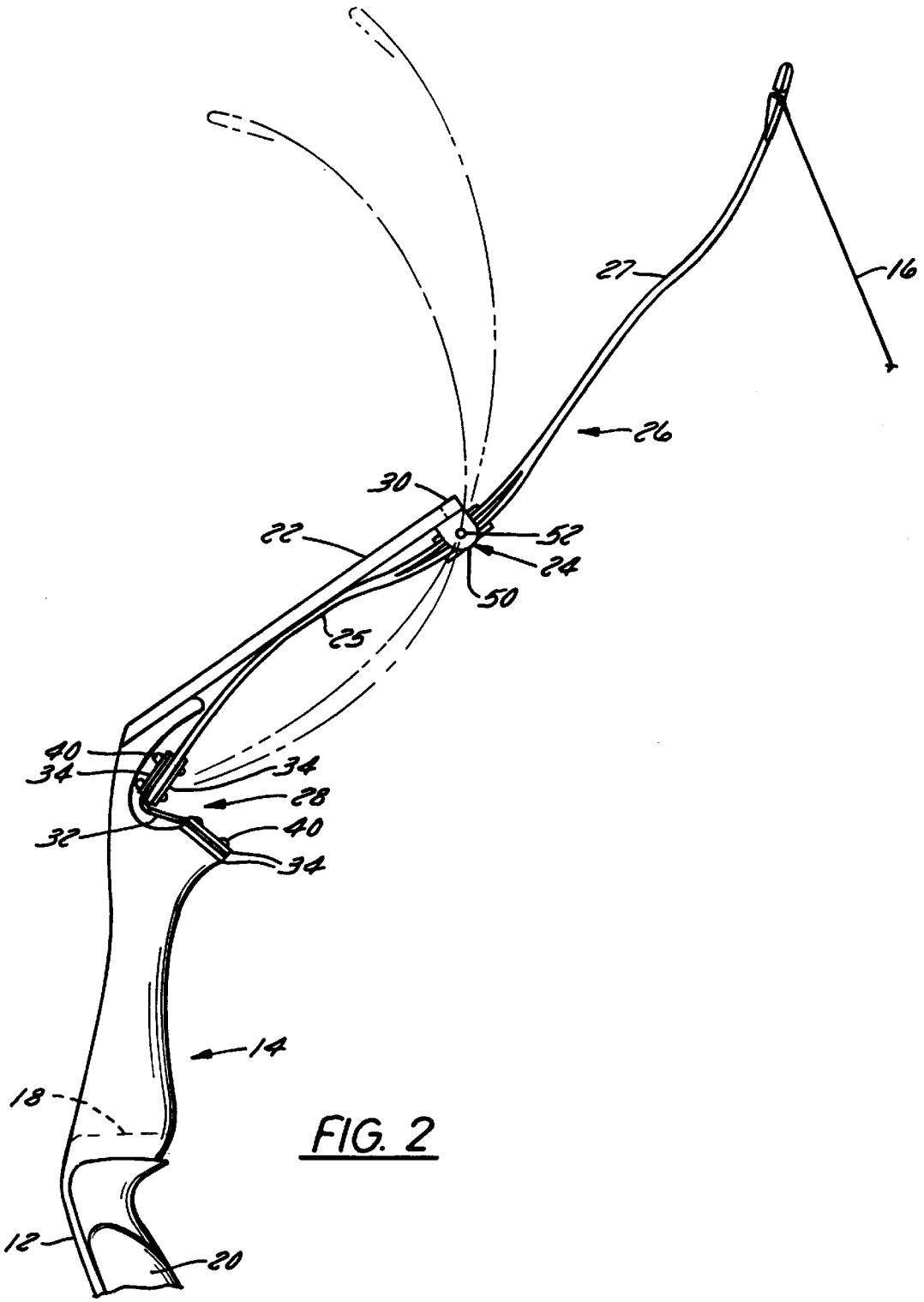
FIG. 2 is a view similar to FIG. 1 showing the limb in the drawn position.

In operation the bow 10 is held by grasping the handle portion 12 of the riser 14, seating an arrow (not shown) on the bowstring 16 with the arrow aligned with an arrow rest 18 on the riser 14. The arrow is then drawn back to the last position shown in FIG. 2 and released when aligned with the target.

More particularly the riser 14 includes a handle section 20 intermediate the ends thereof. A support member 22 is mounted on each end of the riser 14 each of which angle rearwardly and outwardly from the riser 14. A bearing assembly 24 is provided at the outer end 30 of each of the support members 22. A limb 26 is pivotally connected to each of the bearing assemblies 24 with the inner ends connected to the riser by a reed assembly 28.

The reed assembly 28 as shown in FIGS. 3 and 4 operatively connects the inner end 44 of the limb 26 to the riser 12. The reed assembly includes a rectangular reed 32 of carbon steel, such as blue tempered and polished spring steel, having a pair of plates 34 aligned with each end of the reed 32. A pair of notches 36 are provided on each side of each end of the reed 32. Each plate 34 is provided with a pair of holes 38 on each side which are aligned with the notches 36. Screws 40 or bolts 42 are aligned with each hole 38 in the plates and each notch 36 in the reed 32. One end of the reed 32 is secured to the riser 14 by the screws 40. The other end of the reed 32 is aligned with the inner end 44 of the limb and secured thereto by plates 34 and bolts 42.

It should be noted that the reed 32 is bent with a small radius at an angle of approximately 90° to match the limb end 44. With this arrangement the inner end 44 of the limb can move linearly and at the same time angularly without any friction to the limb's motion. In addition to the angular and lateral motions, the reed assembly 28 positively guides the inner end 44 of the limb against twisting. These two points of positive guiding improve the anti-twisting resistance of the limb's upper extension.

The bearing assembly 24 which is mounted on the outer end of the support member 22 pivotally supports the limb 26. In this regard and referring to FIGS. 3 and 5 the bearing assembly 24 includes a bracket 46 mounted on the outer end of the limb 22 by a nut and bolt assembly 48. A pair of ears 50 are formed on each end of the bracket 46 for supporting a pivot pin 52. A notch 54 is provided in the bracket 46 in alignment with a notch 56 in the limb to provide sufficient clearance to pivot the limb 26 on the pivot pin.

The support member 22 may act to stop the pivotal motion of the lower half 25 of the limb 26 in order to positively sequence the limb's different working sections. In this regard means 58 can be positioned on the support member 22 to limit the pivotal motion of the lower limb section 25. Such means can be in the form of a number of shims 59 or a screw which could be adjusted to limit the motion of the limb section 25 in order to positively sequence the limb's different working sections. Of course bow 10 may be configured such that support member 22 does not interfere with limb 26.

Contrasted with existing limbs found on a recurve or compound bow, the location of the pivot assembly 24 necessitates an increased cross section tapered limb 26 with the maximum cross section located at the pivot point of the bearing assembly 24. This diminution of the two limbs' cross section can be achieved in different ways. For example, by using hard maple wood laminations 64 and 66 as shown in FIGS. 6 through 12. Other materials such as fiberglass, carbon fiber, metals or other suitable materials be utilized in the lamination. Each of the lamination sets could be tapered with the two tapered laminations assembled back-to-back.

In this regard and referring to FIGS. 6, 7 and 10, each lamination 64 and 66 is formed with outer laminations 64A and 66A and inner laminations 64B and 66B. The outer laminations 64A and 66B have a constant thickness from end to end. The inner laminations 64B and 66B have thicknesses which vary progressively to the center of the limb. The two laminations 64 and 66 being interconnected from end to end with a tapered phenolic center piece 60 positioned between the laminations 64 and 66 with the pivot pin 52 aligned with a hole 62 in the center piece 60.

Referring to FIGS. 8 through 12 cross sections are shown of the progressive change of the inner thickness of the laminations 64B and 66B. FIGS. 8 through 12 show cross sections of the limbs wherein the outer laminations 64A and 66A are of a constant thickness and the inner laminations 64B and 66B increase in thickness from the outer ends to the center of the limb. In FIG. 8 the thickness of the laminations 64B is 0.035 and 66B is 0.035. In FIG. 9 the lamination 64B is 0.055 and 66B is 0.055. In FIG. 10 the cross section 64B is 0.065 and 66B is 0.065. The phenolic insert 60 has a cross section of 0.090 at the center. In FIG. 11 the cross section 64B is 0.059 and 66B is 0.059. In FIG. 12 the cross section 64B is 0.045 and 66B 0.045. The center lamination 60 has a thickness 0.090 at the center and tapers outwardly from the center of the bow.

Further, it is possible to employ an additional bracket (not shown) which would be attached to the outer portion of the limb to receive the pivot. In this manner the limb need not require additional thickness at the pivot point.

In an alternative embodiment the limb may be formed with parallel laminations of consistent thicknesses which change continuously in width. Whichever method is used the reduction of cross section on the two end parts of both limbs is used to generate an even distribution of the limb's stress and degree of flexibility.

Figure 13:
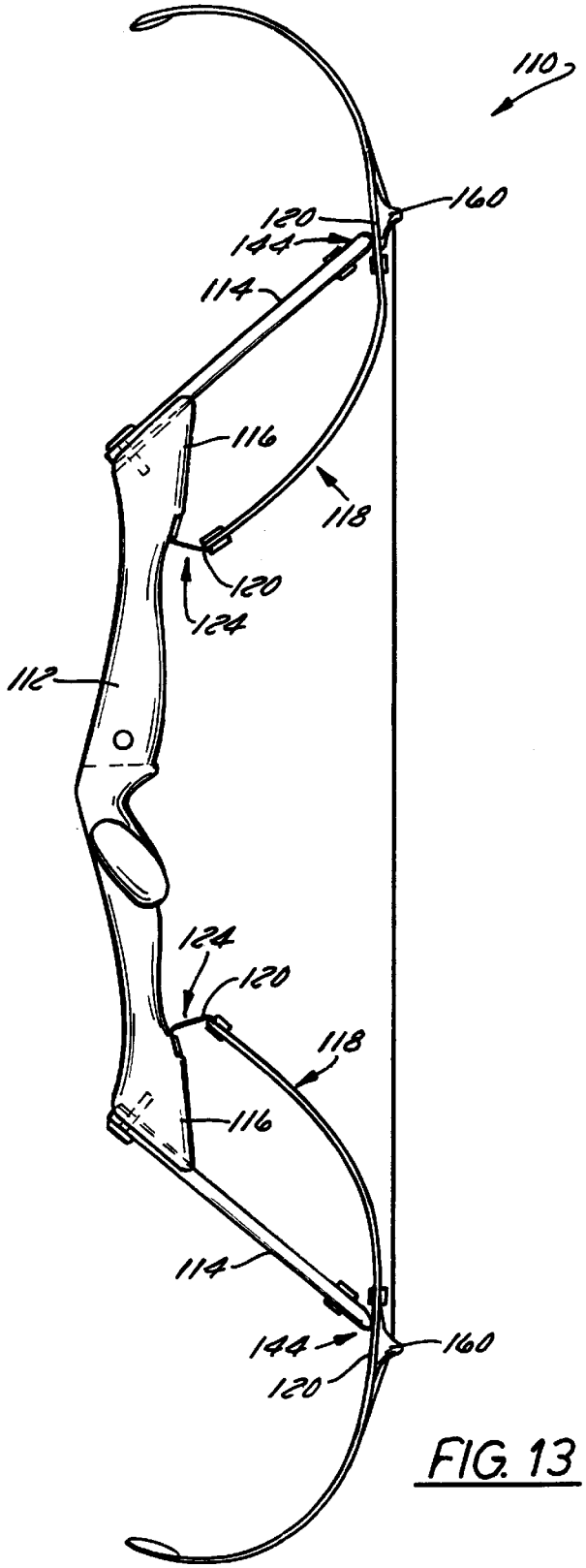
FIG. 13 is a side view of a second embodiment of a bow with a dual reed assembly.

In another embodiment illustrated in FIG. 13, a bow 110 includes a riser 112. Bow 110 further includes a pair of support members 114 mounted on each end 116 of the riser 112 respectively. Each support member 114 is angled rearwardly and outwardly from the riser 112. Bow 110 also includes a pair of limbs 118 each having a bottom end 120 secured proximate a respective end 116 of the riser 112, and a middle portion 122 secured to a respective outer end of the support member 114.

Figure 14:
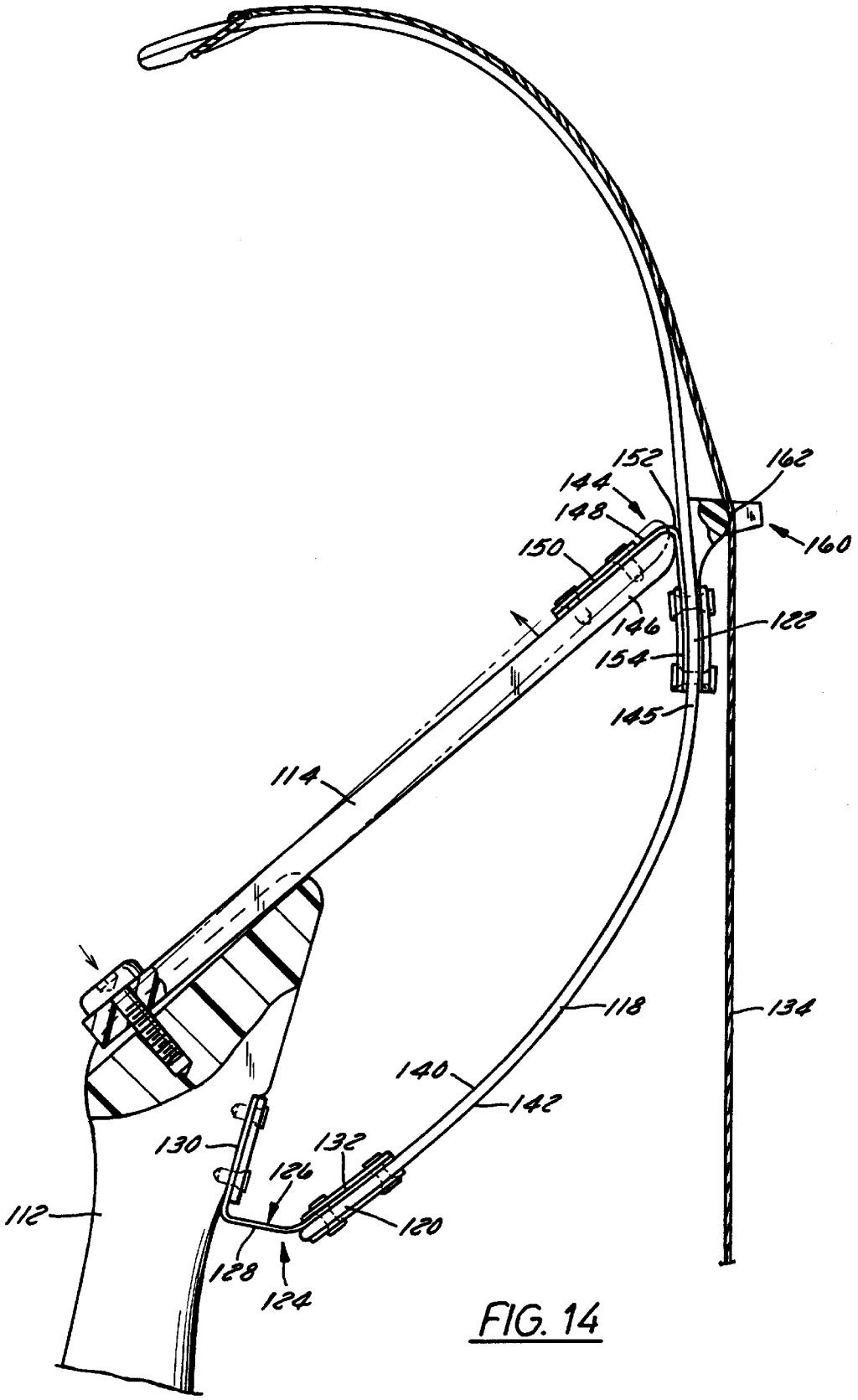
FIG. 14 is a side view of the upper half of the bow according to the second embodiment.

As in the embodiment discussed above, the bottom end 120 of each limb 118 is secured to the riser 112 with a bottom reed assembly 124. As illustrated in FIGS. 13 and 14 each bottom assembly reed 124 includes a spring strip 126 having a central portion 128, a first end 130 secured to the riser 112 and a second end 132 secured to the bottom end 120 of the limb 118. In this embodiment, second end 132 extends rearward from the riser toward the bowstring 134, this is in contrast to the embodiment illustrated in FIGS. 1 and 2. The spring strip 126 may be reinforced as illustrated in FIG. 15 and detailed below.

Figure 15:
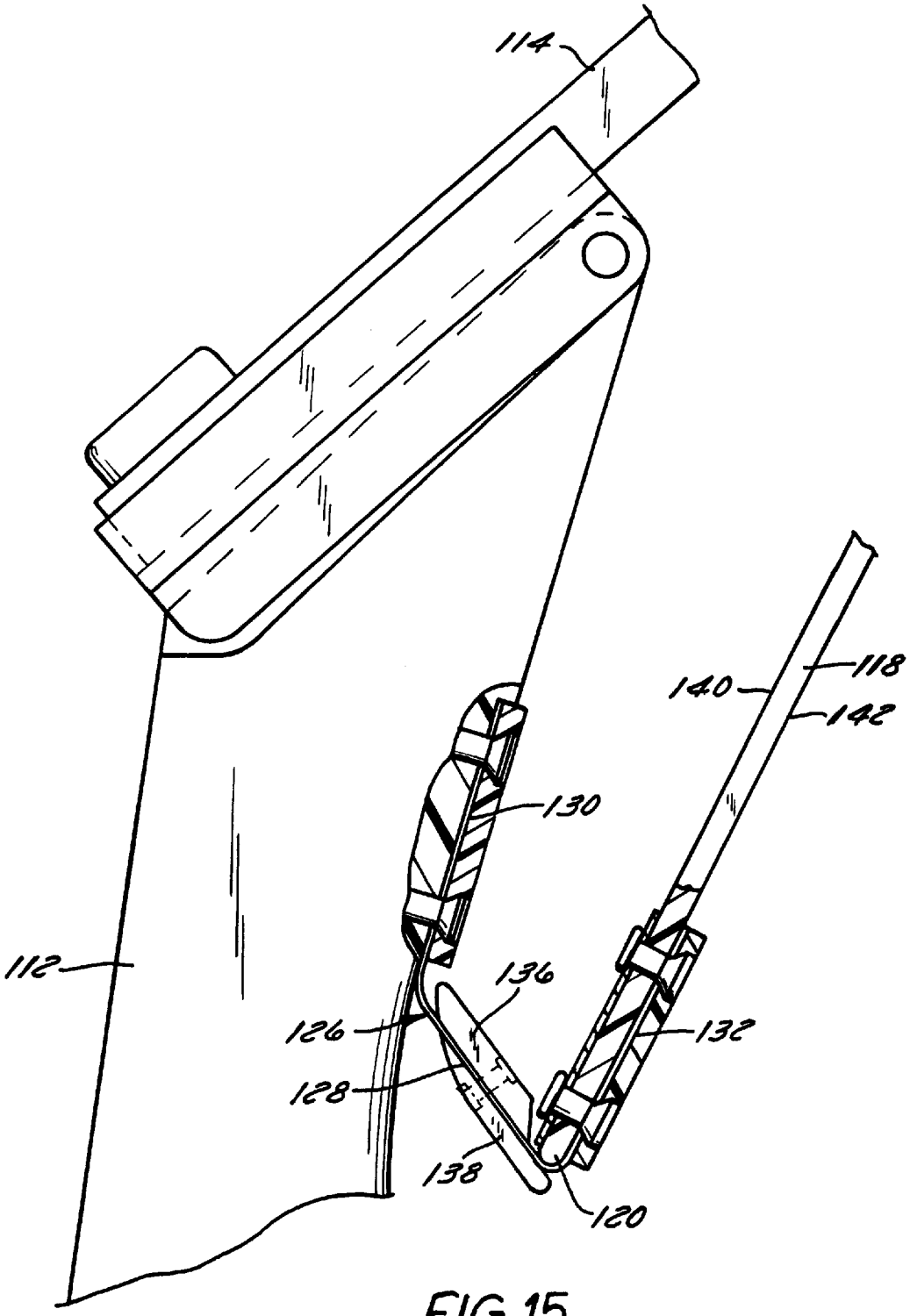
FIG. 15 is a side view of a reed assembly including two metal stiffeners.

As illustrated in FIG. 15, a top and bottom metal stiffener 136, 138 may be located on either side of the central portion 128 of the spring strip 126 to provide increased rigidity as well as to prevent any buckling of the spring strip 126 during operation of the bow. Bottom spring strip 126 may be formed of stainless steel or some other suitable material. Similarly, the stiffeners 136, 138 may also be formed of other suitable materials.

Figure 16:
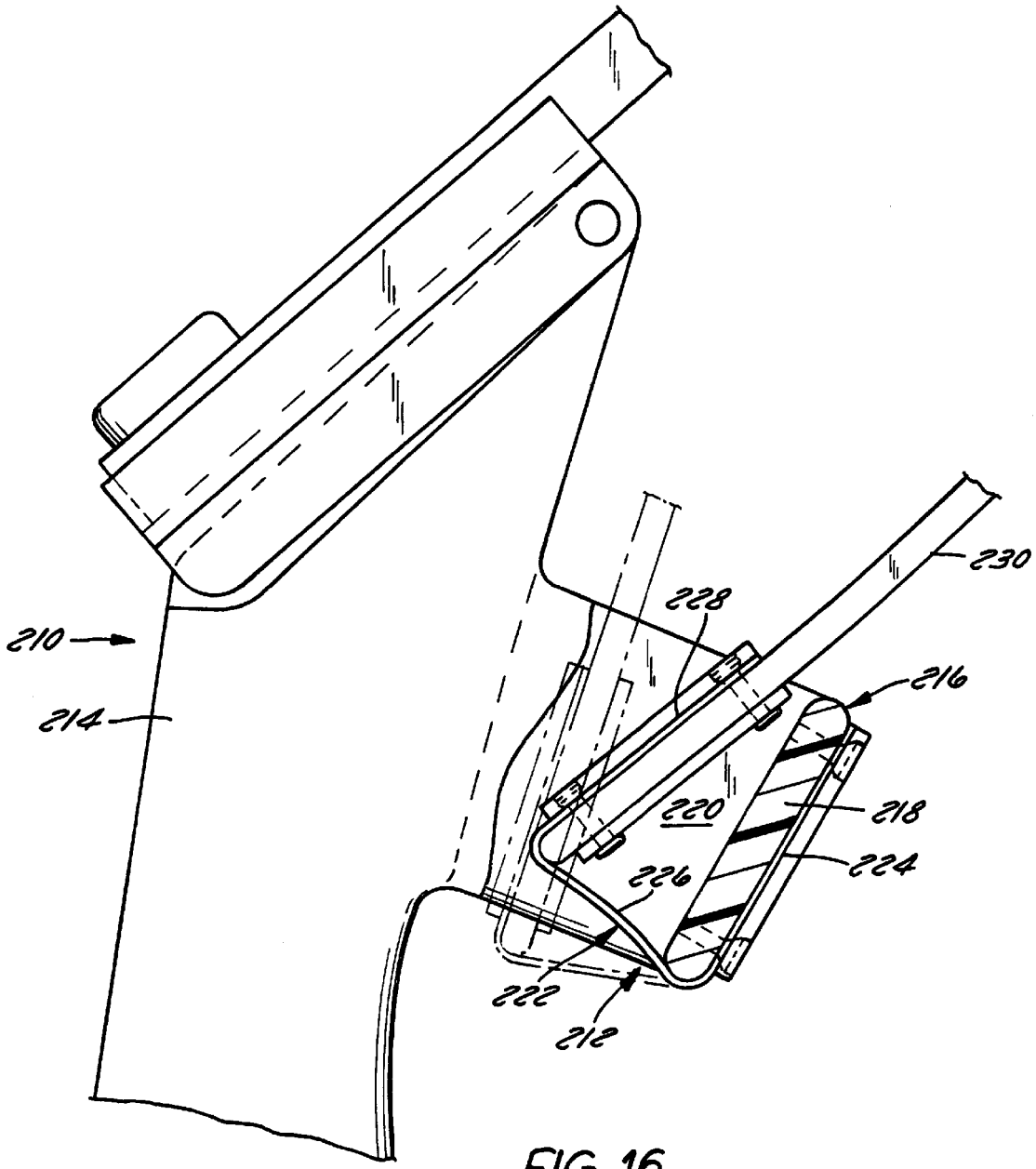
FIG. 16 is a further alternative embodiment of a bottom extension reed assembly without a need for a stiffener.

As illustrated in FIG. 14, the bottom spring strip 126 may be attached to the inner surface 140 of limb 118. However, as illustrated in FIG. 16 it is also possible to attach the spring strip 126 to the outer surface 142 of limb 118. Where the spring strip 126 is attached to the outer surface 142 of the limb 118 there is the potential that the bottom end 120 of the limb 118 will interfere with the top stiffener 136 attached to the spring strip 126. Accordingly, in this embodiment, the top stiffener 136 is offset a set distance from the bottom end 120 of the limb 118 to ensure clearance between the bottom end of the limb and the top stiffener when the bow is fully drawn.

The bottom reed assembly 124 illustrated in FIG. 13 is a compression reed such that when the bow is in its fully drawn position, the reed is compressed. This is in contrast to the reed assembly illustrated in FIGS. 1 and 2 in which the reed assembly is under tension when the bow is fully drawn.

In a further embodiment, illustrated in FIG. 16, a bow 210 employs an extension reed assembly 212. In this embodiment bow 210 includes a riser 214 having an extension member 216 extending away from the riser toward the bowstring. A ledge 218 extends from the extension member 216 thereby forming a cavity 220 between the ledge 218 and the riser 214. In this embodiment a spring strip 222 includes a first section 224 secured to the ledge 218, a central portion 226 extending away from the ledge 218 toward the riser 214, and a second portion 228 secured to the limb 230. In this manner, the limb 230 is located intermediate the ledge 218 and the riser 214. When the bowstring is fully drawn, as illustrated in dashed lines in FIG. 16, the limb 230 moves away from the ledge 218 and towards the riser 214.

Referring back to FIGS. 13 and 14, an upper reed assembly 144 is secured to the middle section 145 of each limb 120 and to the upper portion 146 of each support member 114. Upper reed assembly 144 includes a spring strip 148 having a first end 150 secured to the ends 146 of the respective support member 114, a central portion 152, and a second end 154 secured to the central region 122 of the respective limb 118.

Figure 17:
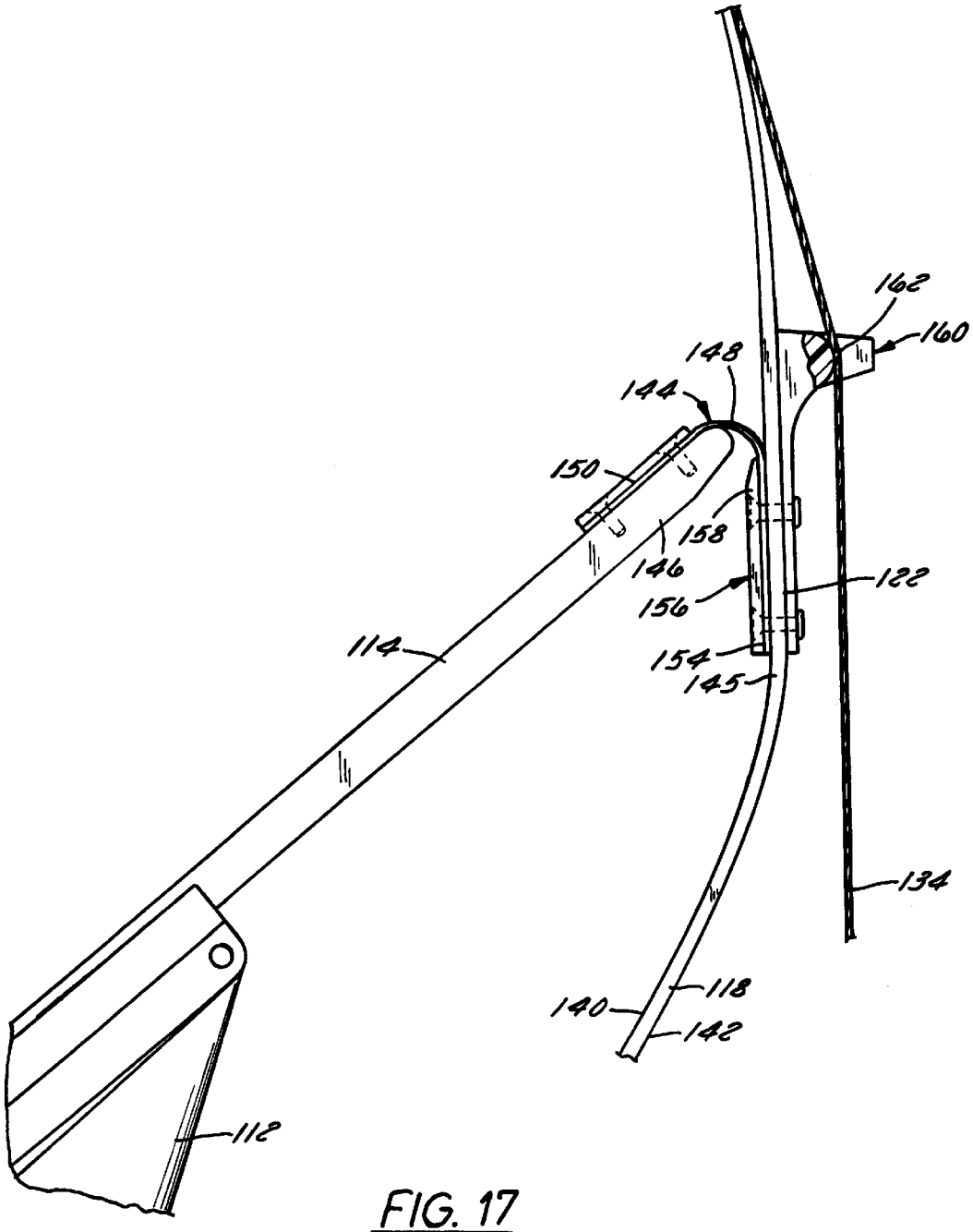
FIG. 17 is a side view of the upper reed assembly with a reed support bracket in the brace height position.
Figure 18:
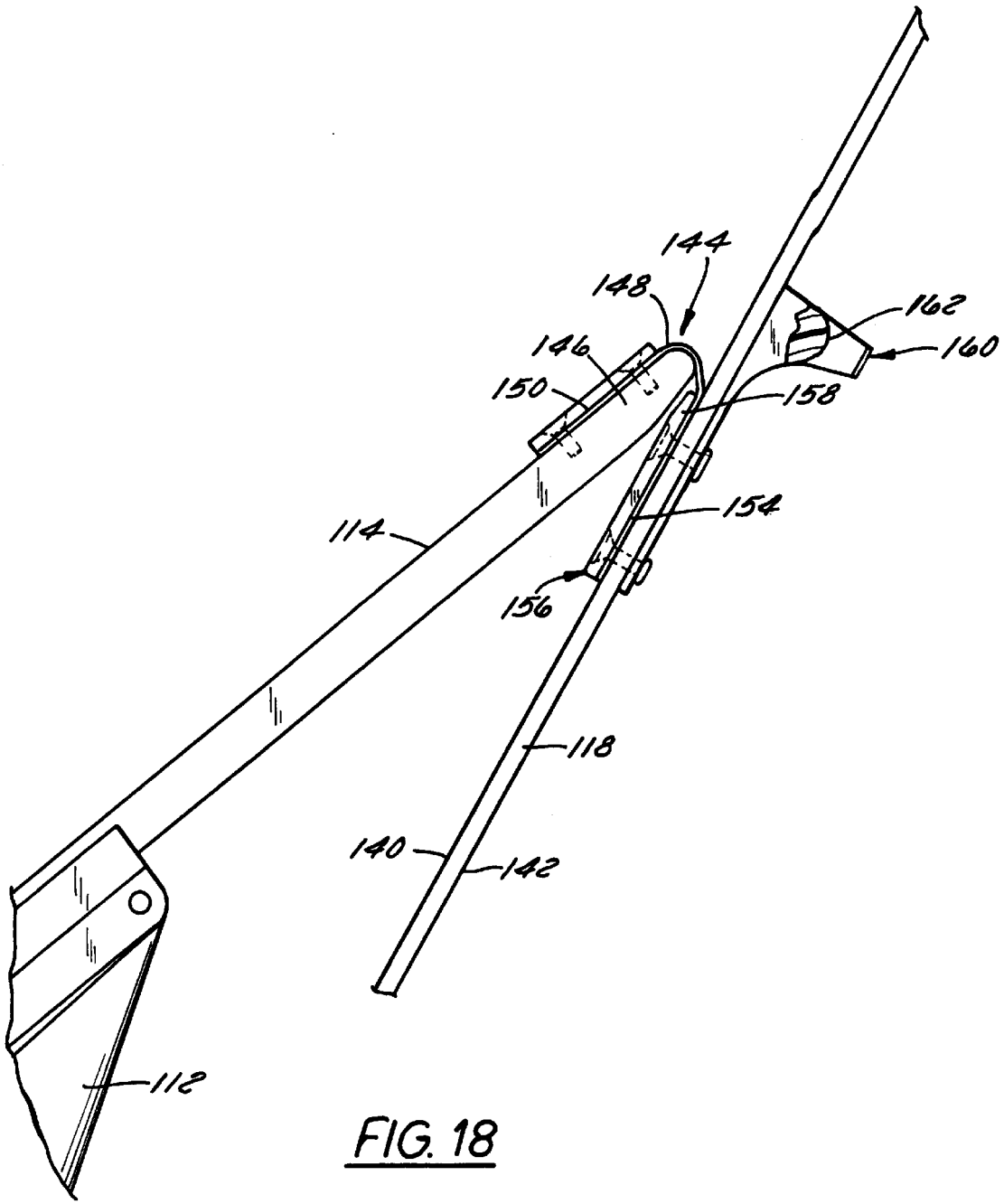
FIG. 18 is a side view of the upper reed assembly of FIG. 17 in the full draw position.

In order to further enhance the rigidity and guidance of the reed assembly, an upper support bracket 156 may be secured to upper reed assembly 144. As illustrated in FIGS. 17 and 18, upper support bracket 156 acts to keep limb 118 tight against support member 114 at the point of rotation when the bowstring 134 is fully drawn. Upper support bracket 156 is secured to the limb 118 and includes an upper portion 158 configured to support the upper spring strip 148 proximate the end 146 of support member 114 when the bow is fully drawn. (See FIG. 18). In this manner, the upper spring strip 148 is supported during draw of the bow thereby minimizing free unwanted movement of the limb 118 during its rotation.

Figure 19:
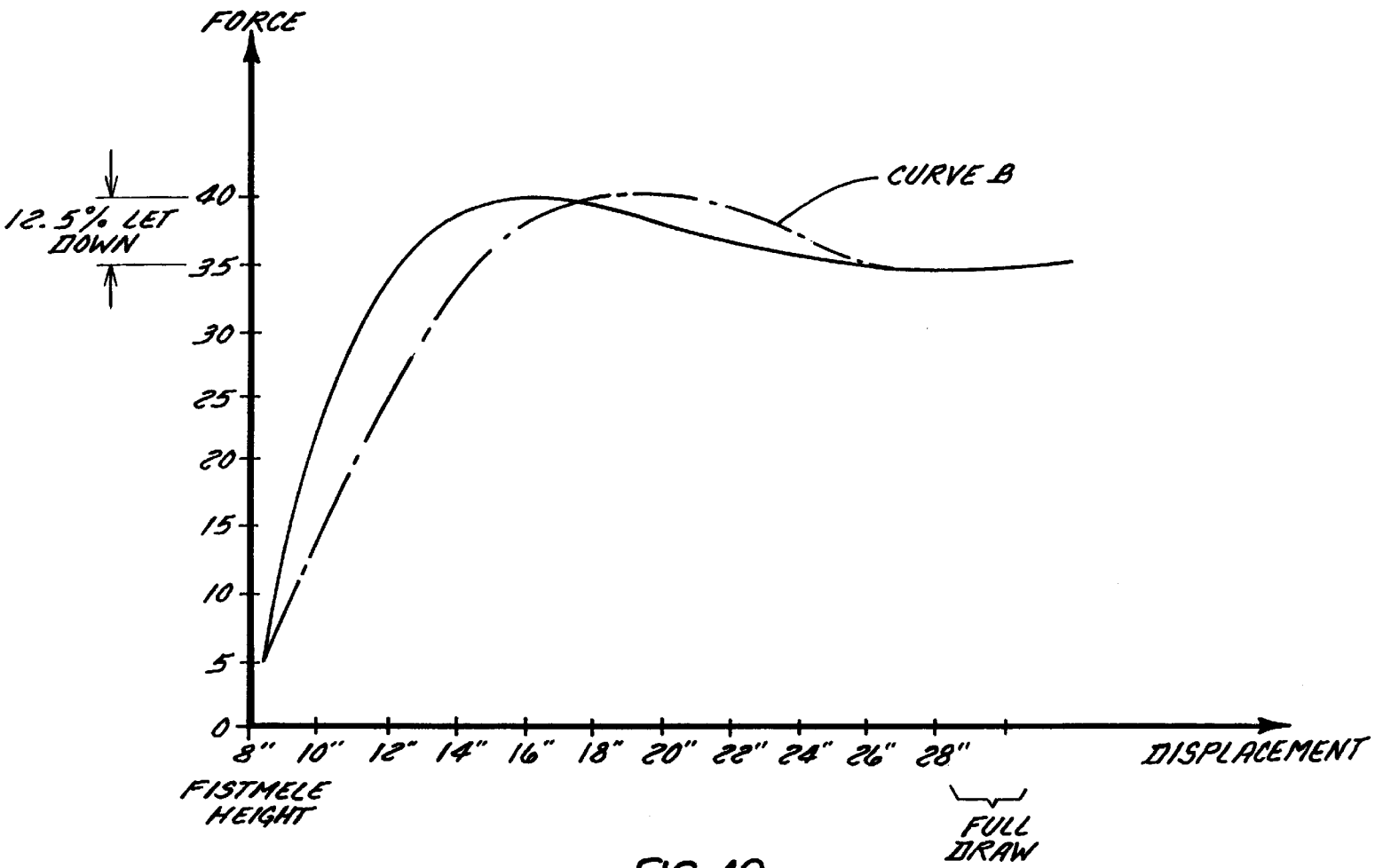
FIG. 19 is a table illustrating let down as a function of the force verses displacement.

Additionally as illustrated in FIGS. 14 and 17 a string guide 160 having a v-shaped groove 162 is located proximate the upper reed assembly 144 to guide the bowstring 134 during the draw and release of the bowstring 134. The string guide 160 distances the bowstring 134 from the limb 118 which changes the string action on the limb 118. The offset allows for an increase in the initial drawback force per unit displacement of the bowstring 134. FIG. 19 illustrates that the maximum drawback force is achieved in less displacement of the bowstring when string guide 160 is employed. In addition to achieving the maximum drawback force earlier with the use of the string guide 160, the let down of drawback force is also achieved earlier. Curve A represents the drawback force per displacement of the bowstring with the use of the string guide 160. Curve B represents the drawback force per displacement for the same bow without the use of a string guide.

Figure 20:
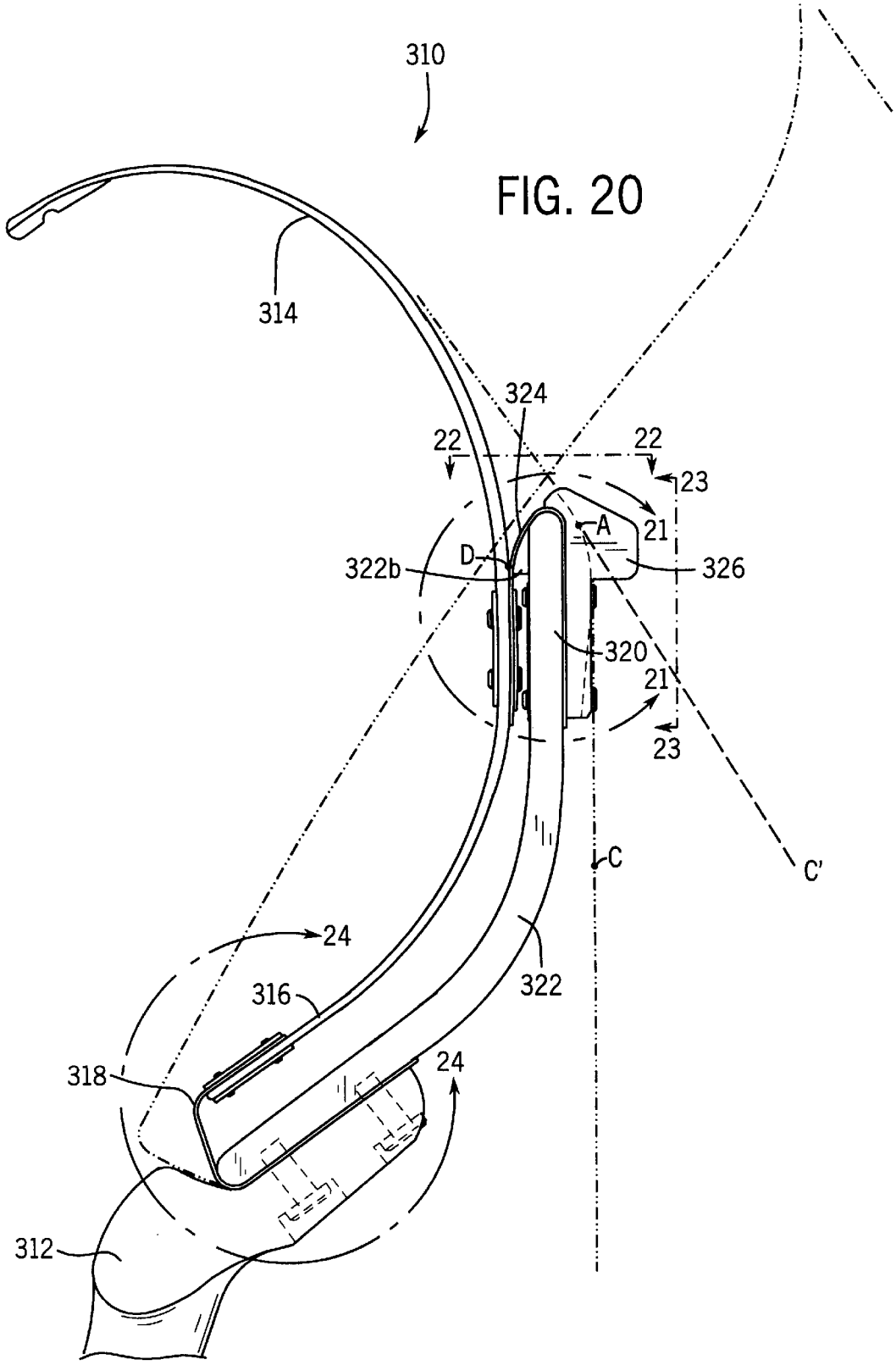
FIG. 20 is a side view of the bow according to a third embodiment.
Figure 24:
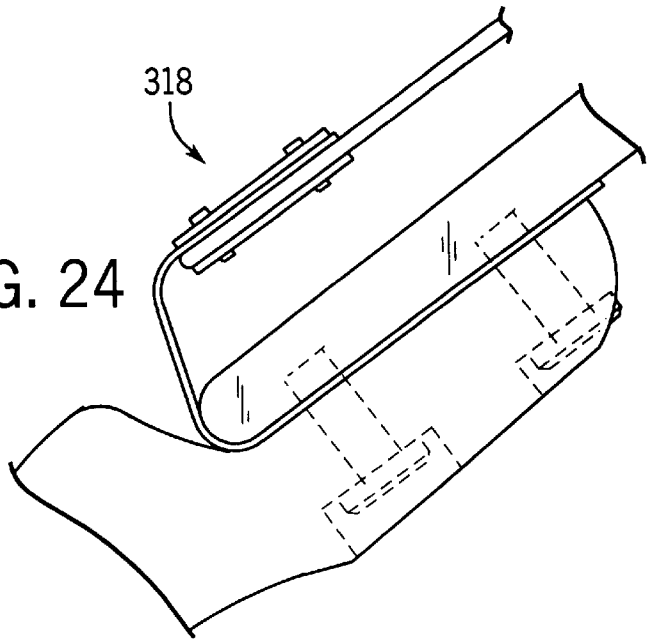
FIG. 24 is the bottom reed assembly taken generally along line 24—24 of FIG. 20.

In another embodiment illustrated in FIG. 20, a bow 310 includes a riser 312, and a pair of limbs 314. Only a portion of one half of the bow 310 is illustrated in FIG. 20. The front face of the bow 310 will be defined as the side of the bow that faces the archer, while the rear of the bow will be defined as the side of the bow distal the archer. Each limb 314 includes a lower portion 316 attached to a rear face of riser 312 with a lower reed 318. This arrangement permits the lower reed assembly 318 to be in tension. Each limb 314 is further attached to the front face of an extension member 322 with an upper reed 324. While FIG. 20 shows the use of an extension member 322 extending from the end of the riser, the riser and extension member could be a unitary component in which case the riser would not have a separate extension member but rather an extension portion. It should be noted that the limb 314 is located on the rear side of the riser, that is the side of the riser facing away from the archer.

As illustrated in FIGS. 20 and 21, a separate member **322*b* may be secured to extension member 322 to provide additional support and guidance to upper reed 324. It is also possible to manufacture the extension member 322 to include the portion 322*b* as a single component. Separate member 322*b* also acts to support the limb. The separte member 322** may be manufactured from the same material as the extension member or any other suitable material.

A string guide 326 is attached to the front face of extension member 322 and serves both as a string guide during the operation of the bow as well as a fastener of the upper reed 324 to extension member 322. The string guide 326 as illustrated in FIG. 21 is attached to extension member 322 with four bolts 328. Of course any other type of fastener known to one skilled in the art may be used to secure the string guide and reed to the bow. The upper reed 324 is clamped between the string guide 326 and the extension member 322. In this manner the upper reed 324 is securely fastened to the bow.

String guide 326 includes a "V" shaped groove 330 extending the length of the string guide. The string at release is in contact with the groove on the limb's free end. There the curvature of the recurve is such to maintain string contact with the groove. This curvature geometry is also a key in keeping the bow steady during the draw. When the string is released from full draw, it is guided by the groove on the limb during the first portion, then the string guide takes over with its "V" shape and the groove combination guides the string and positions it in the bottom of the groove as the string comes to the fistmele height.

The string guide also spaces the string from the front of the limb's articulation. In the preferred embodiment this distance is 1.375, the distance is identified in FIG. 21 as the distance between points A and D. This distance is key to bringing a quick rise of the draw force curve. When the archer draws the string, it starts from a position illustrated in FIG. 20 along line A–C. The distance between A and D does not change during the initial pulling of the string. The force necessary to pull the string increases very rapidly. At the start the string has a theoretical angle CAC' before the string will start to lift from the string guide groove. As the archer starts to pull on the string he also starts rotating the limb, as a result the point in the draw of the string in which the string lifts from the string guide will be less that the angle CAC'.

The distance of the spacing between points A and D is key in bringing a quick rise of the drawing force, its increase or decrease will affect the force needed to pull the string and determine how stiff the force is rising up.

Figure 25:
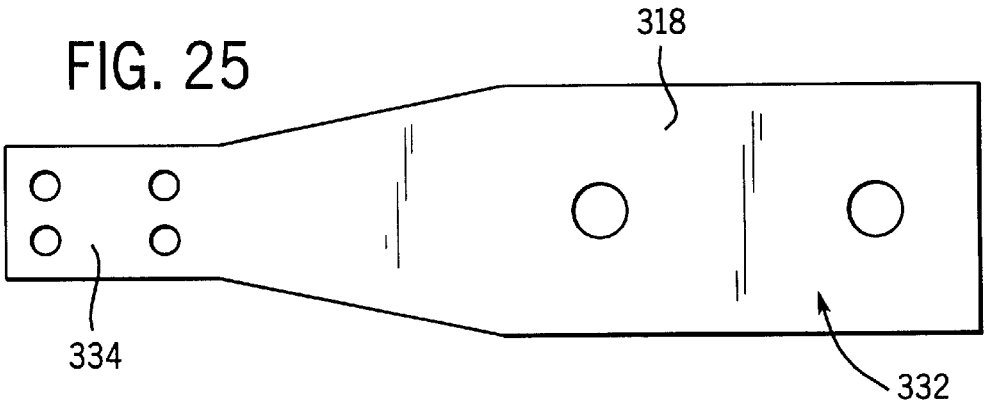
FIG. 25 is a plan view of the bottom reed blank of FIG. 20.
Figure 26:
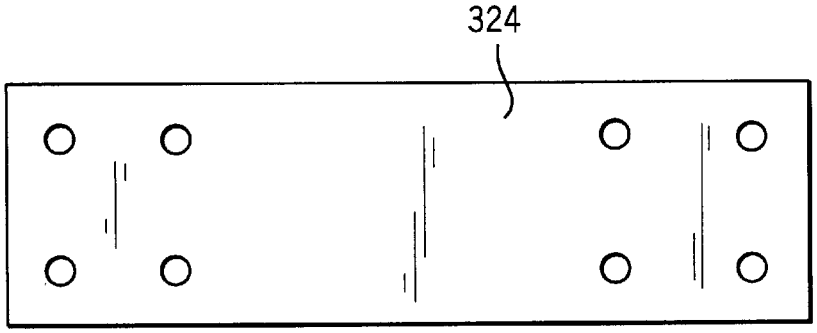
FIG. 26 is a plan view of the top reed blank of FIG. 20.

As illustrated in FIG. 25, bottom reed 318 includes a first region 332 for attachment to the riser, and a second region 334 for attachment to the limb. The width of second region 334 is narrower than the width of the first region 332 to accommodate for the varying widths of the riser and limb. In contrast the upper reed 324 is shown to be of a constant width, this is due to the fact that the limb is wider in its center region. Of course other reed geometries may be employed.

The use of a reed may also be used to secure a limb in a compound bow. FIGS. 27 and 28 illustrates the bottom of a compound bow 350 in which a limb 352 is attached to a riser 354 as a separate member. A lower reed 356 secures the limb 352 to the riser as illustrated. Similarly, as illustrated in FIG.

29 a pair of upper reeds 360 secures string cam guide 360 to the end of limb 352. Although only one upper reed 360 is shown, a second upper reed 360 is located on the second side of the cam pivot.

Figure 30:
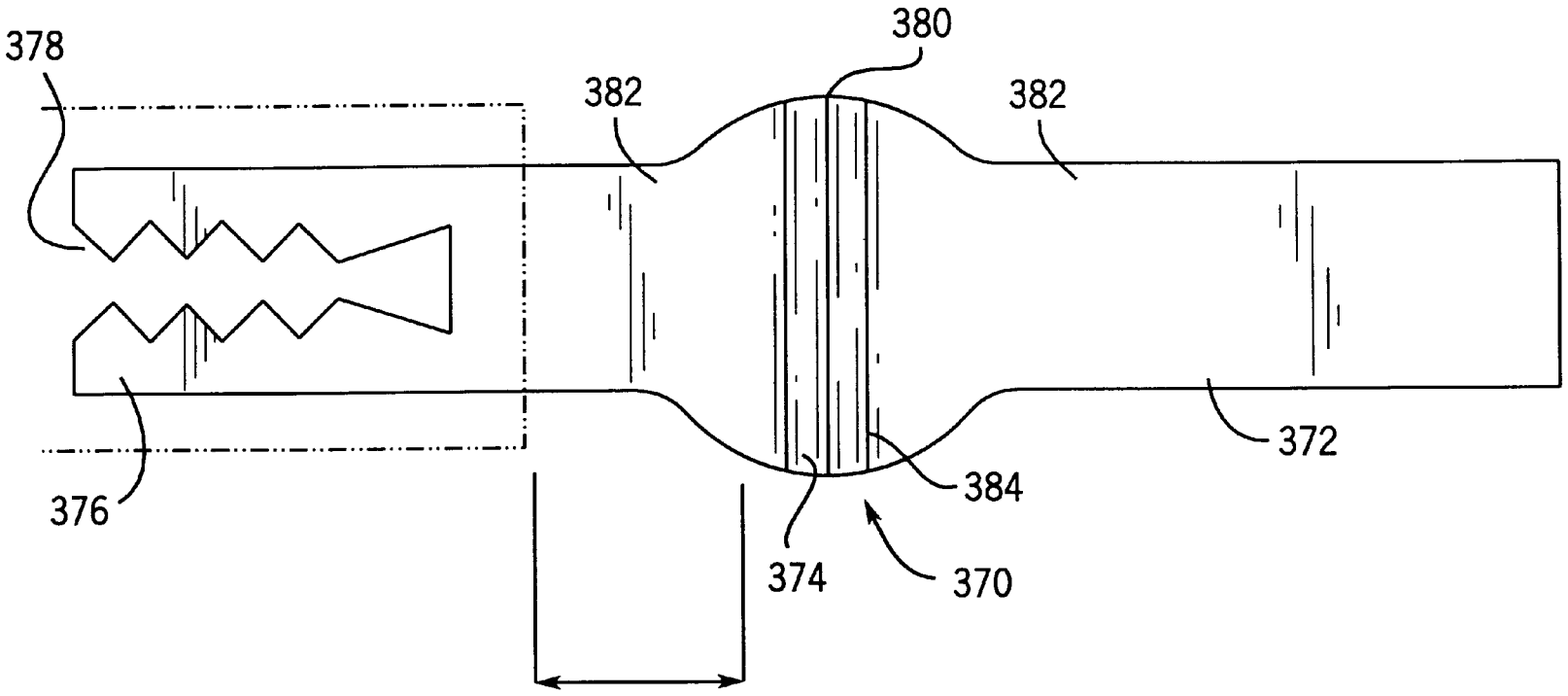
FIG. 30 is a plan view of an alternative spring strip configuration.

The geometry of the reeds may be varied to improve the performance of the reed assemblies. As illustrated in FIG. 30, an exemplarary reed 370 includes three distinct regions, a first region 372 for attachment to the riser or extention member, a second central region 374, and a region 376 for attachment to the limb. The first and/or the third region may include a cut out portion 378. However, in the embodiment illustrated in FIG. 30, only the third region includes a cut out portion. It may be possible however, for one or both of the first and third regions not to have a cut out.

The first region and or third regions may be laminated to the surface of the riser with the use of an overlay. In this embodiment, the first region is adhesivley bonded with expoxy glue to the riser or extension support with an overlay. Alternatively, the first and third regions may be set inbetween the laminations of the riser or extension member and limb and epoxy glued. In this manner the strength of the bond between the riser or the extention member and the reed, and the limb and the reed is increased. The cut out portion aids the overall strength of the bond by providing additional surface area to prevent slippage of reed relative to the riser, extension member or limb.

The second central region 374 could also include a middle portion 380 having a width greater than two side portions 382. The greater width of the middle portion 380 adds additional rigidity to the reed such that when the bow is drawn, the reed flexes predominately in the side portions 382. Middle portion 380 may further include raised ribs 384 either parallel or transverse to the longitudinal axis of the reed. The ribs further increase the rigidity of the center portion of the reed and or direct the line of flexion to the side portions. Additionally, the raised ribs provide greater stiffening of the material when the reed is used in compression.

As discussed above, the use of a reed provides great precision in movement of the limb relative to the riser. However, in order to ensure that the reed operates in a predictable and repeatable manner, the radius between the side portions 372, 376 and center portion 370 when the bow is drawn must not fall below a predetermined minimum value. The minimum radius will vary based upon the gage of the reed material. Flexure of the reed beyond the minimum radius could result in fatigue of the material and ultimately to either failure of the reed or a reduction in the repeatability of the reed's performance. In one preferred embodiment, the reed is formed from a carbon spring tempered steel material SAE 1070–1090 having a tensile strength of 269,000 PSI and a thickness of 0.016 inches. The radius of the reed for an upper reed assembly would require a minimum radius of 1.0 inch. Of course if a different material or material thickness/width is employed then the minimum radius would be modified as well.

Thus, it should be apparent that there has been provided in accordance with the present invention a bow limb articulation that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A bow comprising:

a riser;

a pair of flexible limbs, each limb having opposing ends, each limb being operatively connected to the riser at one of the respective ends with a reed assembly including a thin strip of metal material having a thickness less than a thickness of the limbs.

2. The bow according to claim 1, wherein the thin strip of material is blue steel.

3. The bow according to claim 2, wherein the riser includes a support portion extending from each end of the riser.

4. The bow according to claim 3, wherein each of the limbs are operatively connected to the support portion with a second reed assembly intermediate the two ends of each limb.

5. The bow according to claim 4, wherein the first and second reed assemblies are in tension.

6. The bow according to claim 2, wherein the riser includes a front surface that faces an archer, a string guide being attached to the front surface of the riser.

7. The bow according to claim 6, wherein the string guide includes a longitudinal groove for receiving the bowstring.

8. The bow according to claim 6, wherein the string guide supports a bowstring at a predetermined distance from the limb.

9. The bow according to claim 1, wherein the bow is a compound bow including a wheel, at least one of the limbs being operatively connected to the wheel with a reed assembly.

10. The bow according to claim 1, wherein the bow is a compound bow including a cam, at least one of the limbs being operatively connected to the cam with a reed assembly.

11. A bow comprising:

a riser;

a pair of limbs, each limb having opposing ends, each limb being operatively connected to the riser at one of the respective ends; and a string guide located on the riser at a position intermediate the ends of one of the limbs for guidance of a bowstring.

12. The bow according to claim 11, wherein the riser includes a front surface that faces the archer, the string guide being located on the front face of the riser.

13. The bow according to claim 12, wherein the string guide includes a longitudinal groove for receiving and guiding the bowstring.

14. The bow according to claim 11, wherein the string guide supports the bowstring at a predetermined distance from the limb.

15. A compound bow comprising:

a riser;

a pair of limbs, each limb having opposing ends, each limb being operatively connected to the riser at one of the respective ends; and a wheel operatively connected to one of the limbs with a reed assembly.

16. The bow of claim 15, wherein each limb is operatively connected to the riser with a second reed assembly.

17. The bow of claim 15, further including a cam being operatively connected to one of the limbs with a second reed assembly.

* * * * *